US005894992A

United States Patent [19]

Liu et al.

[11] Patent Number: 5,894,992

[45] Date of Patent: Apr. 20, 1999

[54] HYDRAULICALLY ACTUATED FUEL INJECTOR WITH INJECTION RATE SHAPING PRESSURE INTENSIFIER

[75] Inventors: Chung Y. Liu; Amarjit S. Ghuman; Benjamin M. Yen; Lester L. Peters, all of Columbus; Edward D. Smith, Greensburg, all of Ind.

[73] Assignee: Cummins Engine Company, Inc., Columbus, Ind.

[21] Appl. No.: 08/682,966

[22] Filed: Jul. 18, 1996

Related U.S. Application Data

[63] Continuation-in-part of application No. 08/414,218, Mar. 31, 1995, abandoned.

[51] Int. Cl.[6] ..... F02M 47/02

[52] U.S. Cl. ..... 239/91; 239/92; 239/533.4

[58] Field of Search ..... 239/533.4, 90, 239/91, 92

[56] References Cited

U.S. PATENT DOCUMENTS

| | | | |
|---|---|---|---|
| 5,094,397 | 3/1992 | Peters et al. | 239/91 X |
| 5,143,291 | 9/1992 | Grinsteiner | 239/88 |

*Primary Examiner*—Lee W. Young
*Attorney, Agent, or Firm*—Sixbey, Friedman, Leedom & Ferguson; Charles M. Leedom, Jr.; David S. Safran

[57] ABSTRACT

Fuel injection rate shaping is integrated into the pressure intensification stage of a hydraulically actuated fuel injector having a pressure intensifier. In a first embodiment, the pressure intensification plunger is formed of two parts creating a damping chamber therebetween from which fluid is forced out through orifices in a lower one of the plunger parts during an initial phase of displacement of the upper part. Thus, injection will be performed initially at a lower pressure and rate, which increases once the plunger parts make contact. In a second embodiment, a throttled flow is set via a restrictor housing that telescopingly receives the upper plunger part, so that a lower injection rate occurs while fluid is bled off through a restricted flow path between the restrictor housing and the upper plunger part, and a higher injection rate is produced once a port in the upper plunger clears the restrictor housing. In a third embodiment, the two plunger parts of the intensifier have different areas relative to each other. In a fourth embodiment, flow to the intensifier plunger is varied by the intensifier plunger co-acting with a shaped inlet port increasing the effective area of the inlet port through which flow enters the intensifier as the intensifier plunger is displaced during its injection stroke. In a fifth embodiment, a throttling effect produced by a clearance between a protrusion on the intensifier plunger and a receiving bore in the intensifier body is used reduce the intensification effect during the initial phase of injection.

1 Claim, 7 Drawing Sheets

HYDRAULICALLY ACTUATED FUEL INJECTOR WITH INJECTION RATE SHAPING PRESSURE INTENSIFIER

CROSS REFERENCE TO RELATED APPLICATION

This application is a continuation-in-part of U.S. patent application Ser. No. 08/414,218, filed Mar. 31, 1995 now abandoned.

BACKGROUND OF THE INVENTION

1. Field of the Invention

The present invention relates to hydraulically actuated fuel injectors of the type having a pressure intensifier, and to the use of rate shaping in fuel injectors for obtaining reduced emissions.

2. Description of Related Art

The use of injection rate shaping (i.e., changing of the injection rate during the injection of fuel by a fuel injector into an engine) for reducing $NO_x$ emissions is known. For example, in U.S. Pat. Nos. 4,718,384, 4,627,571, and 3,669,360, injection rate shaping, producing a lower initial rate of injection and a higher subsequent rate of injection, is achieved by varying the pressure acting on a needle valve at the outlet end of the injector so as to initially restrict the extent that the needle valve opens and then allowing it to open to a greater extent for increased fuel flow. However, these arrangements are not in hydraulically actuated fuel injectors having pressure intensifiers and they are limited to use with closed nozzle fuel injectors, i.e., those having a needle valve at the outlet end thereof. Furthermore, if highly pressurized fuel (for example, 15–20 kpsi) is delivered to these injectors, obtaining of a precise flow rate control will be difficult to achieve.

Likewise, known techniques for producing a two stage (preliminary and main injection) process (e.g., U.S. Pat. Nos. 4,601,269 and 3,404,861) as well as for producing an initially restricted flow of fuel followed by an unrestricted flow of fuel to the injector (e.g., U.S. Pat. No. 3,747,857) also possess deficiencies with respect to the supplying of precisely metered quantities of fuel at very high pressures in a way applicable to a variety of different types of injectors.

SUMMARY OF THE INVENTION

It is a primary object of the present invention to provide a hydraulically actuated fuel injector having a pressure intensifier in which rate shaping is used for obtaining reduced emissions.

In furtherance of the primary object, it is a related object to achieve fuel injection rate shaping in a easy yet precise manner.

Another object of the present invention is to achieve the foregoing objects in a manner that is applicable to a wide range of fuel injection systems, particularly common rail, pump-line-nozzle systems, using closed or open nozzle injectors.

A further object of the present invention is to integrate fuel injection rate shaping into the pressure intensification stage of a hydraulically actuated fuel injector having a pressure intensifier.

These and other objects are achieved in accordance with preferred embodiments of the present invention. In particular, in a most preferred embodiment, the pressure intensification plunger is formed of two parts creating a damping chamber therebetween. Fluid in the damping chamber is forced out through orifices in a lower one of the plunger parts during an initial phase of displacement of the upper part, until contact is made between the plunger parts, so that injection will be performed initially at a lower pressure and rate, which will increase once the plunger parts make contact. In a second embodiment, a similar effect is produced; however, initial injection rate control is obtained by a throttled flow into an internal chamber of the upper plunger part via a restriction member that is telescopingly received in the upper plunger part. In this case, a lower pressure acts to produce a lower injection rate so long as fluid from the damping chamber between the plunger parts is bled off through a restricted flow path between the restriction member and the upper plunger part in which it is housed into the internal chamber, and once this restricted flow path is closed the plunger parts become linked to produce an increased injection rate.

According to a third embodiment of the invention, the two plunger parts of the intensifier not only have different areas relative to the metering and injection plunger of the injector but also with respect to each other. During the initial phase of injection, injection is produced as a function of the ratio of the areas of the upper plunger part to that of the metering and injection plunger, the lower plunger being rendered ineffective due to a bypass port therethrough being open. After the upper plunger part has been displaced a predetermined distance, a port extending though it is opened, effectively bypassing it, while the bypass port of the lower plunger is closed, so that the hydraulic actuating pressure then acts on the lower plunger producing an injection rate that is a function of the ratio between the areas of the lower plunger and the metering and injection plunger.

In a fourth embodiment, flow to the intensifier plunger, itself, is varied. In particular, the intensifier plunger coacts with a shaped inlet port in a manner increasing the effective area of the inlet port through which flow enters the intensifier as the intensifier plunger is displaced during its injection stroke. As such, a slow start is produced via a small upper inlet port or an upper reduced area portion of the inlet port, after which the main injection pressure is achieved when a larger lower inlet port or a lower enlarged area portion of the inlet port is uncovered by downward displacement of the intensifier plunger.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
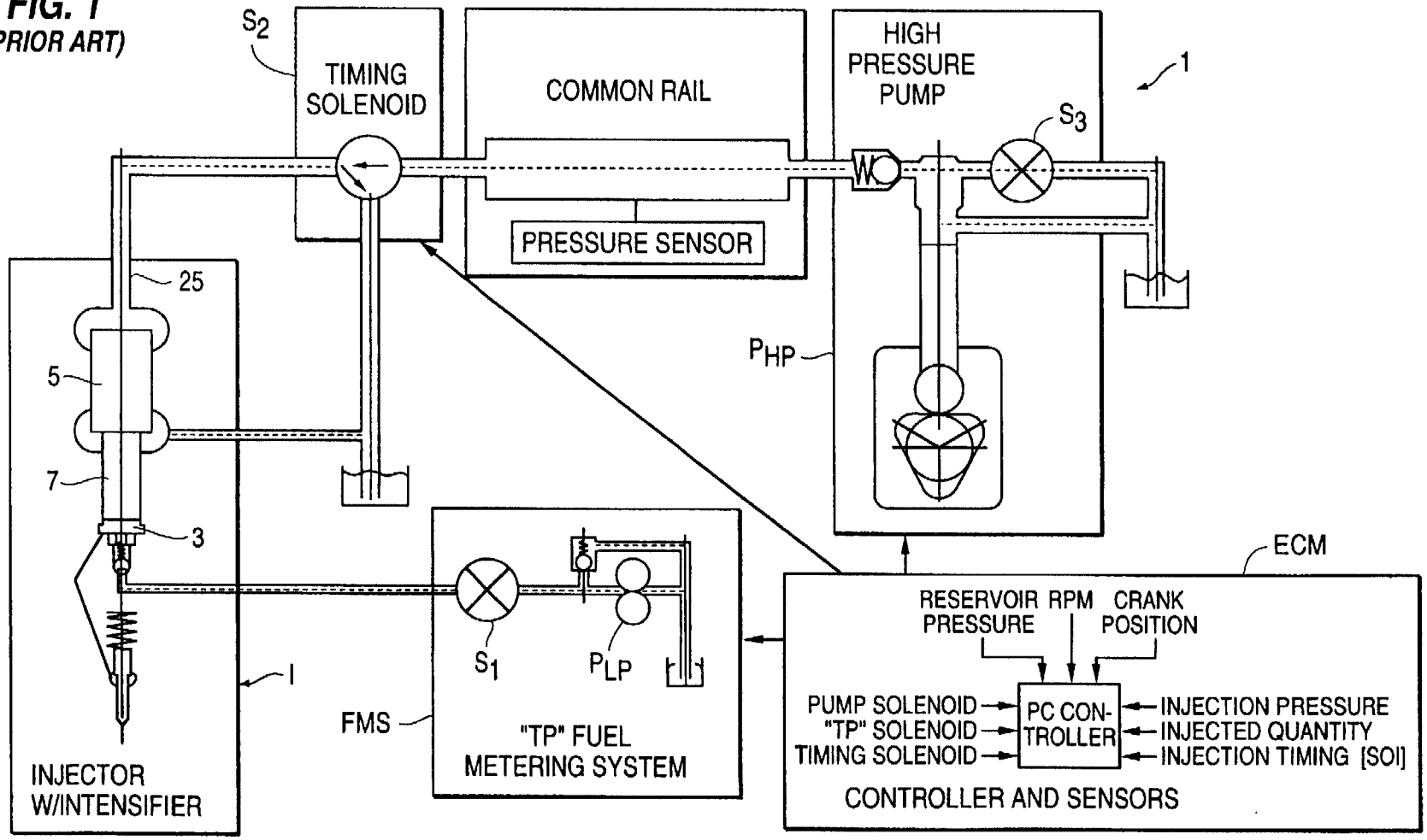
FIG. 1 (PRIOR ART)
FIG. 1 is a schematic depiction of a typical hydraulically actuated fuel injector.
Figure 2:
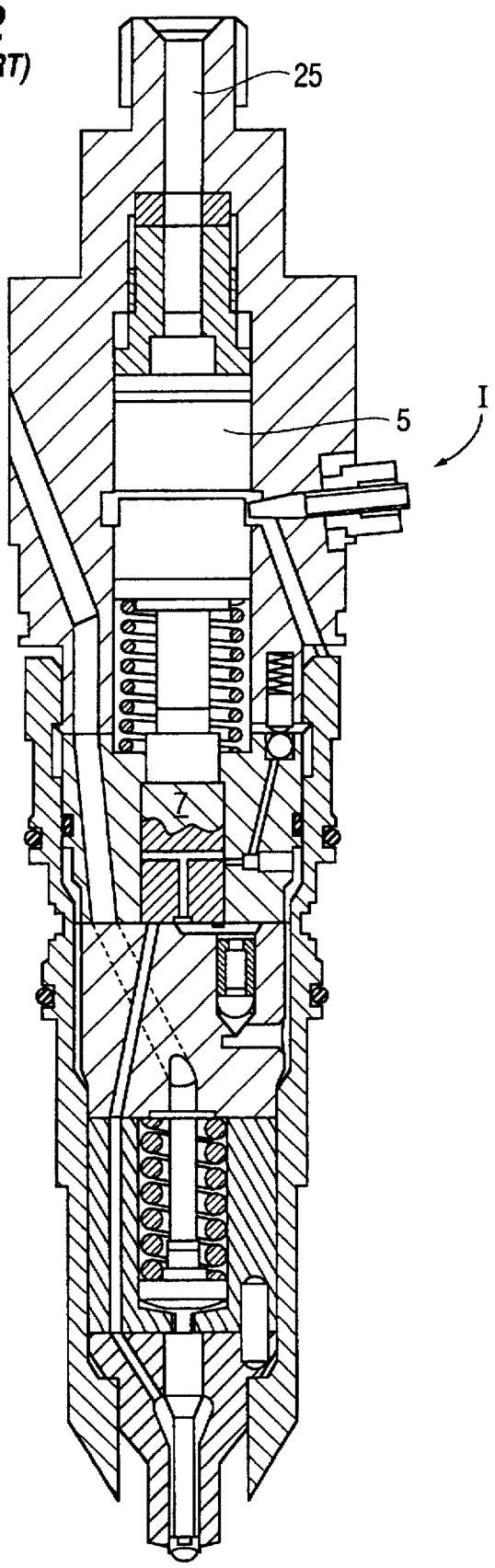
FIG. 2 (PRIOR ART)
FIG. 2 is a cross-sectional view of a known fuel injector with an injection pressure intensifier.

FIG. 1 illustrates a type of known fuel injection system of a type in which a fuel injector of the present invention will find application and which uses a plurality of hydraulically actuated fuel injectors I of the type shown in greater detail in FIG. 2 and only one of which is represented in FIG. 1. Fuel injection system 1 is of the pump-line-nozzle type. Precisely measured charges of fuel are delivered on a time-pressure (TP) basis to a metering and injection chamber 3 by a fuel metering system FMS having a low pressure pump $P_{LP}$ with a constant delivery rate and a TP solenoid $S_1$ which sets the quantity of fuel delivered based on the time that it is open. To inject the quantity of fuel from the metering and injection chamber 3, a high pressure pump $P_{HP}$ supplies a highly pressurized hydraulic fluid (which can be fuel or lubricant oil) via a common rail to each of the injectors I at a timing determined by a timing solenoid $S_2$. In each injector I, the pressurized hydraulic fluid acts on a hydraulically actuated pressure intensifier that comprises a pressure intensification plunger 5 which acts on a metering and injection plunger 7 for displacement thereof in an injection stroke for forcing fuel from the metering and injection chamber 3 and out of the injector I into a respective cylinder of an engine (not shown). The pressure intensification plunger 5 has an effective surface area which is acted upon by pressurized hydraulic fluid that is greater than the effective area of the metering and injection plunger 7 that acts on fuel disposed in the metering and injection chamber 3, so that the fuel is injected into the engine at a pressure above that of the highly pressurized hydraulic fluid supplied to the injector I by the high pressure pump $P_{HP}$. The entire metering and injection operation is conducted under the control of an electronic control module ECM which controls the opening and closing of the solenoids $S_1$, $S_2$, and $S_3$ as a function of engine operating parameters, such as engine rpm and crank position.

Figure 5:
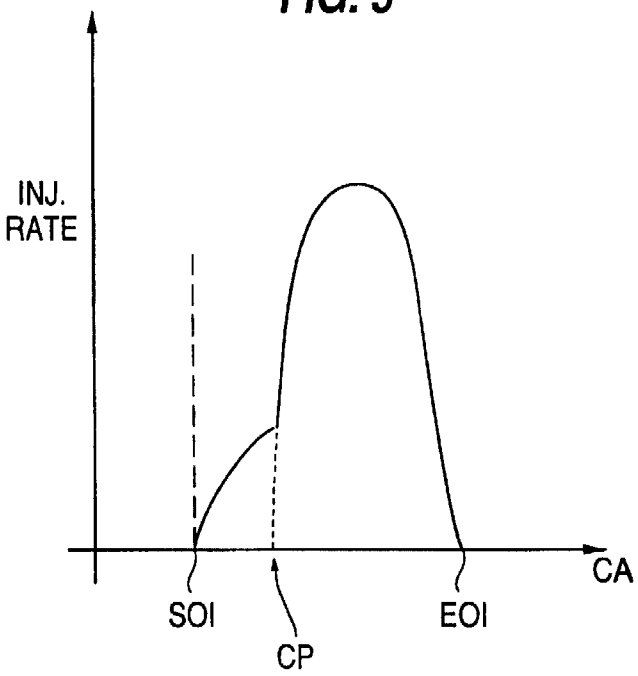
FIG. 5 is a graph depicting injection rate as a function of crank angle for the embodiment of FIGS. 3 & 4.
Figure 4:
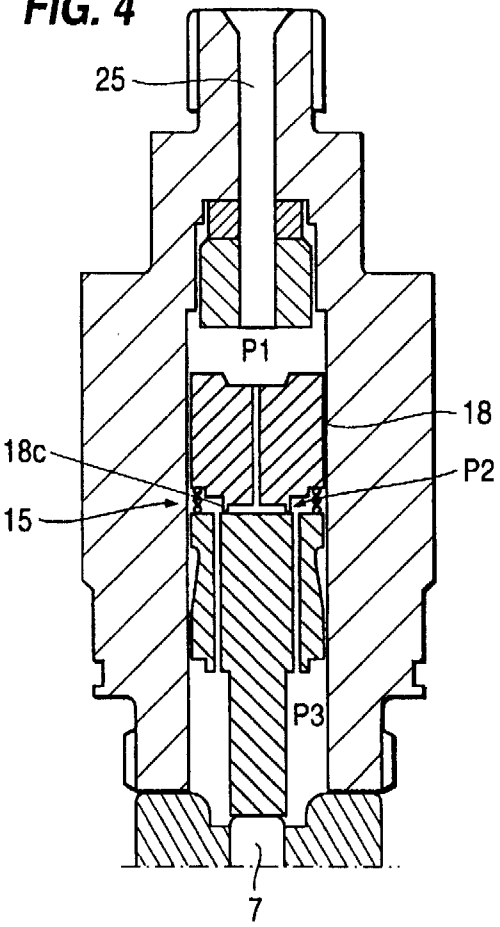
FIGS. 3 & 4 schematically depict a hydraulically damped plunger arrangement for producing injection rate shaping in accordance with a first embodiment of the present invention, at start of injection and end of injection positions, respectively.
Figure 3:
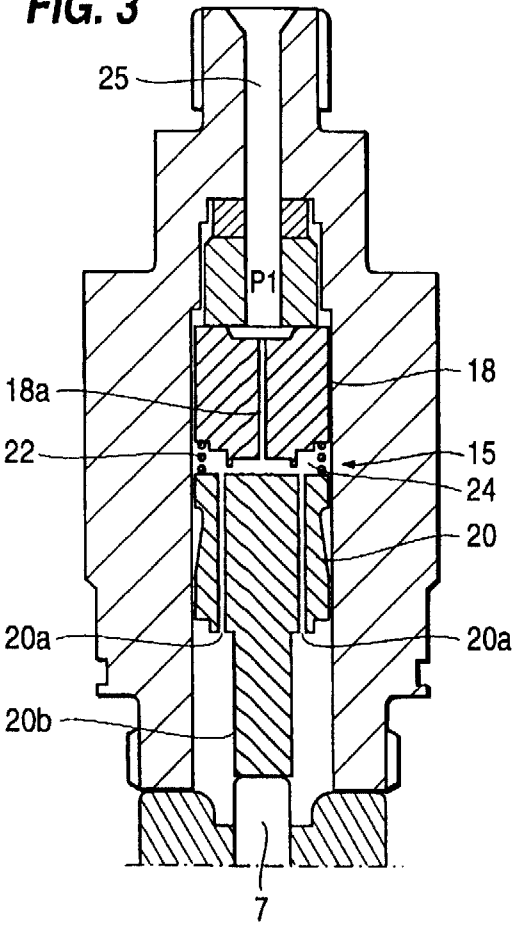

With reference to FIGS. 3–5, it will now be explained how the injector I can be provided with an injection rate shaping capability in accordance with a first embodiment of the present invention. In this regard, FIGS. 3 and 4 merely show the top portion of the injector represented in FIG. 2, which apart from the features described below, is otherwise unchanged.

In this embodiment, the pressure intensification plunger 5 has been replaced by an intensifier plunger 15 that is formed of a pair of relatively movable, upper and lower plunger parts 18, 20. The upper plunger part 18 has a single centrally located orifice passage 18*a* extending axially through it, while the lower plunger part 20 has a pair of orifice passages 20*a* extending axially through it radially outwardly with respect to orifice passage 18*a* and a plunger portion 20*b* which drivingly engages the top of the metering and injection plunger 7. At the start of injection (SOI), the plungers 18, 20 are, initially, held apart by a spring 22, creating a damping chamber 24 between the plunger parts 18, 20. At this point, the driving pressure P1 of the pressurized hydraulic fluid supplied by the high pressure pump $P_{HP}$ to the injector inlet port 25 is greater than the pressure P2 in damping chamber caused by the initial force of the upper plunger, so that the upper plunger part 18 moves down pressurizing the fluid in the damping chamber. In practice, the difference between P1 and P2 will not be very large, and the pressure of fuel supplied to the inlet port 25 may have to be reduced via an inlet orifice in port 25 to obtain an initial delay of sufficient duration. As the upper plunger part 18 moves down, it also displaces the lower plunger part 20 downwardly but due to orifice passages 20*a* in the lower plunger, the fluid in the damping chamber 24 is driven out through the lower plunger part at a rate controlled by the throttling effect of the orifice passages 20*a*. As a result, the pressures P1 and P2 will both be lower than they would be if no orifices were present in the lower plunger part, so that injection starts at a slower rate and the upper plunger part 18 moves toward the lower plunger part 20 as the fluid drains.

Once the upper plunger part 18 engages the lower plunger 20, the orifice passages 20*a* are isolated from the orifice 18*a* by an annular sealing ridge 18*c* (FIG. 4) that is located on the bottom face of upper plunger part 18, radially between the orifice passage 18*a* and the orifice passages 20*a*. From this point, designated CP in FIG. 5, the intensifier 15 functions in the same manner as that shown in FIG. 2 and the injection rate rises with the metering and injection plunger 7 being driven by pressure P1 via the engaged plunger parts 18, 20. At the end of injection (EOI), pressure P1 is zero and on the return stroke the spring 24 separates the plunger parts 18, 20, again, and fluid flows back into the damping cavity 24 through the orifice passage 18*a* of the upper plunger part 18.

Figure 6:
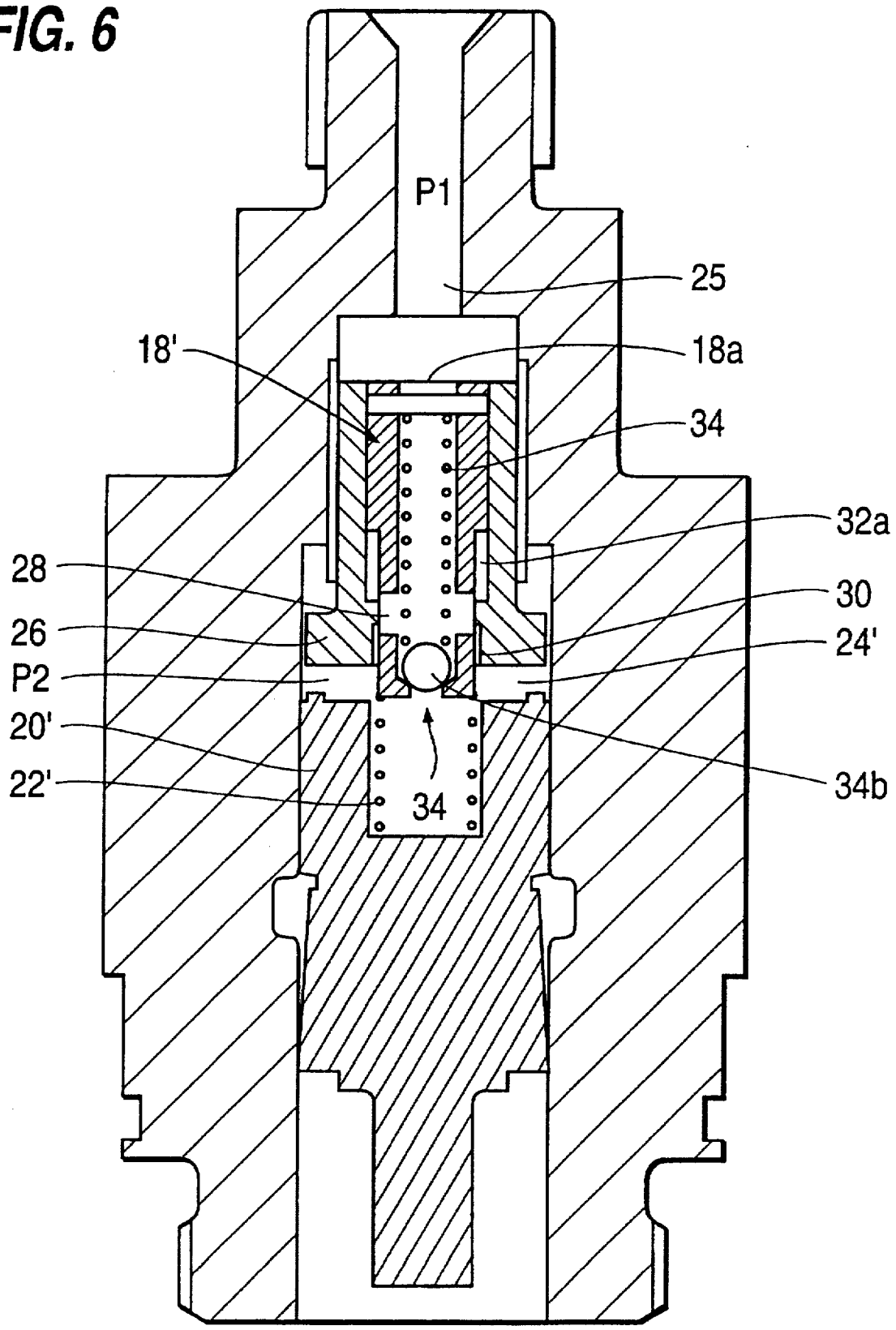
FIG. 6 schematically depicts a throttling intensifier arrangement for producing injection rate shaping in accordance with a second embodiment of the present invention.

FIG. 6 illustrates a second manner in which a lower degree of pressure intensification can be produced initially for achieving a slower initial injection rate. Here, again, the intensifier plunger is formed of a pair of relatively movable, upper and lower plunger parts 18', 20', the upper plunger part 18 having a centrally located passage 18*a* extending axially through it. Likewise, initially, the hydraulic fluid supplied by the high pressure pump $P_{HP}$ to the injector inlet port 25 has a pressure P1 that is greater than the pressure P2 (in link chamber 24') between the plunger parts. However, in this case, the reduced pressure acting to initially displace the lower plunger part 20' is due to a throttling action restricting flow to link chamber 24' as opposed to a restricted release of fluid therefrom.

In particular, a damping chamber 32 is formed internally of a fixed restrictor housing 26, between the restrictor housing 26 and the upper plunger part 18' housed therein. Leakage of fuel from the chamber 32, through the clearance between the restrictor housing 26 and the upper plunger part 18', controls the rate at which upper plunger part 18' descends. Additionally, flow through passage 18'*a* to link chamber 24' via plunger port 28 is restricted by a restricted flow area 30, located between the upper plunger part 18' and restrictor housing 26, resulting in a pressure P2 in link chamber 24' that is lower than pressure P1 during the initial phase of the injection stroke. At the appropriate crank angle, valve port 28 will have moved downward a sufficient distance relative to the restrictor housing 26 to be open at the bottom side of restrictor housing 26. This eliminates the restriction on the flow through the passage 18'*a*, from the top side to the bottom side of the upper plunger part 18', so that the pressure P2 in link chamber 24' becomes essentially the same as the pressure P1. Therefore, the rate of injection increases due to the full fuel pressure being able to act on lower plunger part 22', thereby causing the full intensification pressure to be applied to the metering and injection piston 7 as it continues to move downward.

After completion of the injection stroke, during the upward return stroke, fluid can pass easily out of the link chamber 24' via a check valve 34, which is provided in upper plunger part 18' and is normally closed under the action of a spring 34*a* acting on a valve ball 34*b*. This enables a faster return than could be obtained if the fluid had to pass back through restricted flow area 30.

Figure 7:
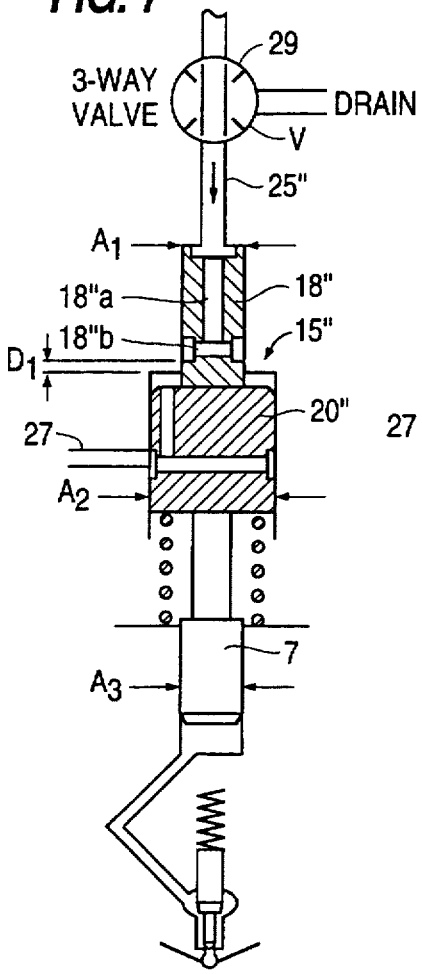
FIGS. 7–9 schematically depict a two-step intensifier arrangement for producing injection rate shaping in accordance with a third embodiment of the present invention, at start of injection, changeover and end of injection positions, respectively.
Figure 8:
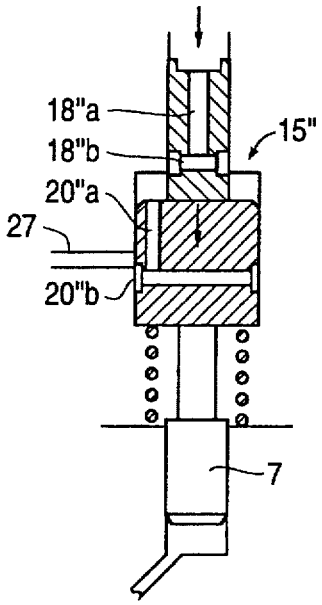
Figure 9:
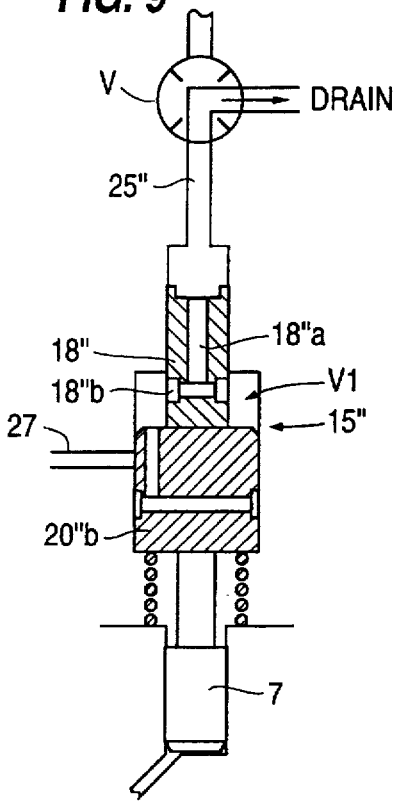

FIGS. 7–9 illustrate another form that the present invention may take. In this case, instead of reducing the effect of the intensifier by reducing the acting pressure via a restricted outflow of fluid, in this case, a two-stage intensifier is produced by making the upper and lower plunger parts 18", 20" of different areas and by using bypass passages to render one, then the other, ineffective.

In particular, the intensifier 15" has an upper plunger part 18" with an area $A_1$ and a lower plunger part 20" with an area $A_2$ that is greater than area $A_1$, and both of these areas are greater than the area $A_3$ of injection and metering plunger 7. Furthermore, the plunger parts 18", 20" each have a bypass passage 18"*a*, 18"*b* running from the top side to the periphery thereof, the top/inlet end of bypass passage 20"*a* being located radially outwardly of the periphery of upper plunger part 18" so as not to be covered thereby.

At the start of injection, represented in FIG. 7, the bypass passage 18"*a* in upper plunger part 18" is closed and the bypass passage 20"*a* in lower plunger part 18" is open to a drain passage 27, so that the two plunger parts act as if they were a single rigid plunger. As such, the pressure of the pressurized hydraulic fluid supplied to inlet 25" acts solely on area $A_1$ of upper plunger part 18" and resulting in an intensification ratio of $A_1$ to $A_3$.

Figure 10:
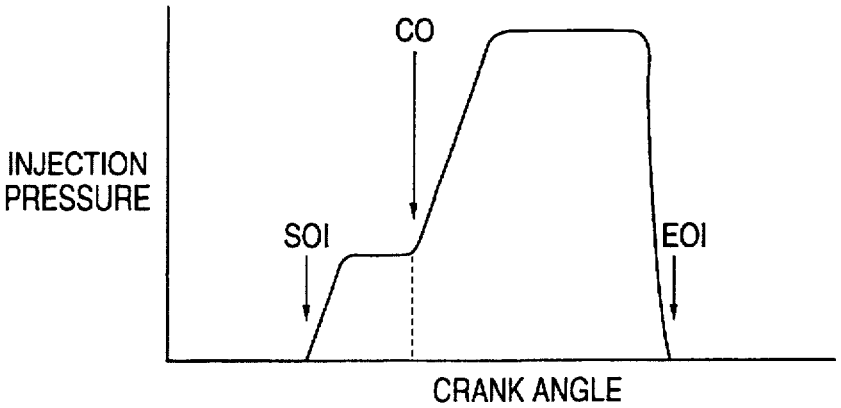
FIG. 10 is a graph depicting injection rate as a function of crank angle for the embodiment of FIGS. 7–9.

FIG. 8 represents the point in the injection stroke where the outlet 18"*b* of bypass passage 18"*a* opens and outlet port 20"*b* of the bypass passage 20"*b* is closed. At this point, the pressurized hydraulic fluid is able to act on the lower plunger part 20" in addition to the upper plunger part 18", so that a higher intensification ratio of $A_2$ to $A_3$ results. FIG. 10 represents the effect of this changeover on injection pressure (and therefore, also on injection rate) with movement from the start of injection position SOI of FIG. 7 to the changeover position CO of FIG. 8 being to the left of the broken line, and with that from the FIG. 8 CO position to the end of injection position EOI of FIG. 9 being shown to the right thereof. During the return stroke from the FIG. 9 EOI position, the inlet passage 25" is connected to drain via the three-way valve V to enable fluid to drain from above the upper plunger part 18" (and also from above the lower plunger parts 20" until the FIG. 8 position is reached once again, at which point the connection of bypass passage 20"*a* to the drain passage 27 is reopened and bypass passage 18"*a* is reclosed, the fluid above the respective plunger parts 18", 20" being separately drained during the remainder of the return stroke).

Figure 11:
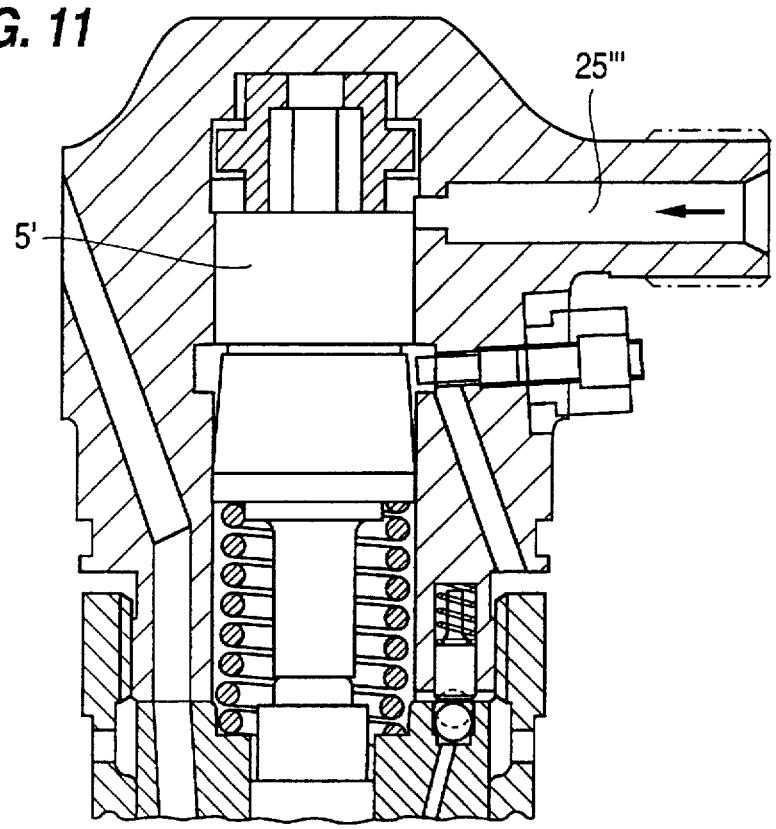
FIG. 11 schematically depicts a variable flow area arrangement for producing injection rate shaping in accordance with a fourth embodiment of the present invention.
Figure 12A:
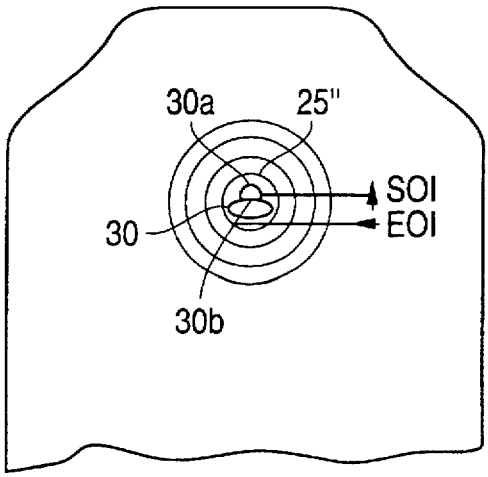
FIGS. 12*a* and 12*b* show two input port configurations for use with the embodiment of FIG. 11.
Figure 12B:
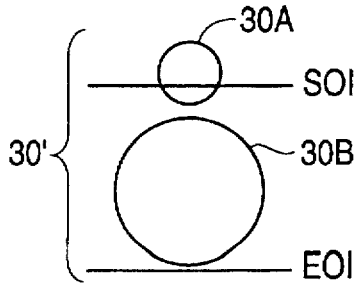

In the embodiments described so far, injection rate shaping has been performed using upper and lower plunger parts and by affecting the point in the injection stroke when the intensifier becomes fully effective. FIGS. 11 and 12 represent a single plunger part approach in which the pressure of the fluid supplied to the intensifier portion of the injector is affected instead. In particular, the inlet passage 25" is moved from the top end of the injector I to the side and is provided with a shaped inlet orifice 30 or orifices 30A, 30B for producing a variable flow area in conjunction with the pressure intensification plunger 5'. As can be seen from the SOI line in FIG. 12*a* and FIG. 12*b*, at the start of injection, the top edge of the intensification plunger 5' is above the large area portion 30*b* of shaped inlet orifice 30 or the larger inlet orifice 30B of the multiport shaped inlet orifice arrangement. As a result, the flow of actuation fluid into the intensifier is restricted to that permitted by the reduced area inlet portion 30*a* or the small inlet port 30A, so that the intensifier will move slowly during the initial phase of injection in comparison to once the intensification plunger 5' has moved downward a sufficient distance to uncover the large area inlet orifice portion 30*b* of shaped inlet orifice 30 or the larger inlet orifice 30B of the multiport shaped inlet orifice arrangement 30'. While this embodiment is structurally the simplest of the embodiments described, it is not the most preferred since it requires precision sizing and placement of the inlet orifice(s) relative to the intensification plunger, is subject to the effects of spring wear and tolerances, and has the least flexibility in terms of fine-tuning or changing of the rate shaping characteristics, once set, should requirements of a particular engine require such, and places limitations on plunger lift, i.e., if plunger lift is reduced too much, rate shaping will be defeated.

Figure 13:
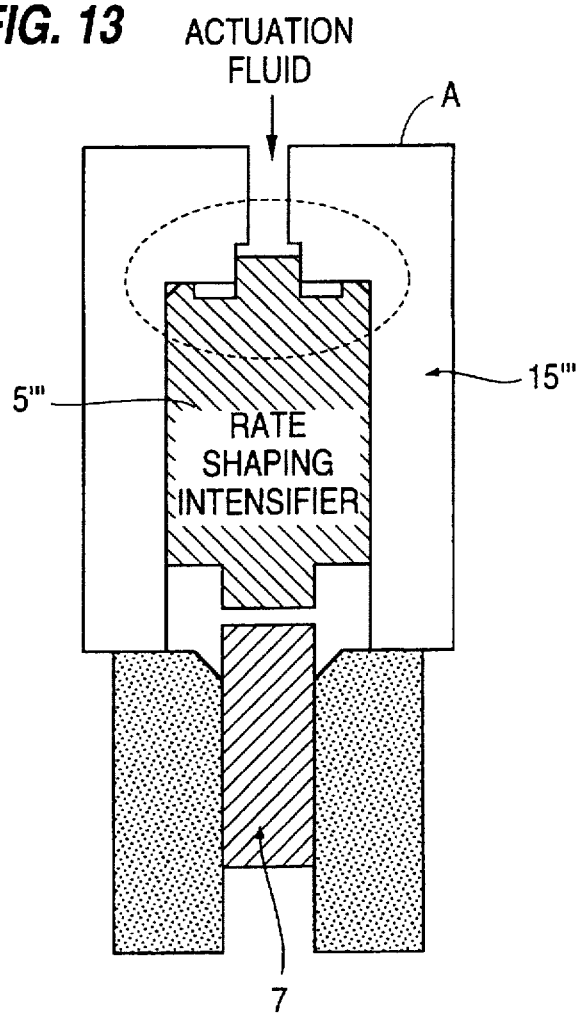
FIG. 13 is diagrammatic cross-sectional view of another embodiment in accordance with the present invention.
Figure 14:
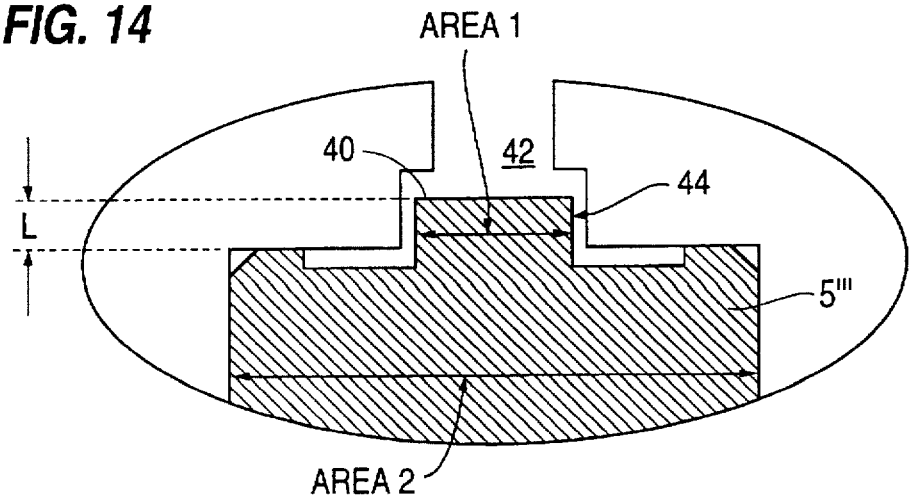
FIG. 14 is an enlarged view of the encircled detail A of FIG. 13.

FIGS. 13 and 14 represent another single plunger part approach in which the pressure of the fluid supplied to the intensifier portion of the injector is affected, so that the pressure intensifier does not become fully effective until a second phase of the injection stroke. In this case, the means for partially reducing the effect of the pressurized hydraulic fluid comprises a protrusion 40 on an upper end of the pressure intensification plunger 5'" and a receiving bore 42 in a facing surface of the body of the pressure intensifier 15'". The protrusion 40 is disposed within the receiving bore 42 during the initial phase of displacement and since the receiving bore 42 has a larger diameter than the protrusion 40, a peripheral clearance space 44 is created between the protrusion 40 and the receiving bore 42 when the protrusion 40 is in the receiving bore 42. The receiving bore 42 is connected to a source of pressurized hydraulic fluid via the inlet passage 25'" and the peripheral clearance space 44 produces a throttling effect which reduces the pressure of the incoming pressurized hydraulic fluid to which the upper end of the pressure intensification plunger 5'" is exposed during the initial phase.

The magnitude of the throttling effect produced is set by the cross-sectional area of the clearance space 44 produced by the difference between the diameters of the protrusion 40 and the receiving bore 42, a suitable amount being 0.05 mm. It is noted that while this throttling effect sets the extent to which the intensification of the pressure applied to the metering plunger 7 is reduced during the initial phase of injection relative to the second phase (which commences upon withdrawal of the protrusion 40 from receiving bore 42), the intensification factor, itself, is determined by ratio of the cross-sectional area of the upper end of the intensification plunger 5'" relative to the cross-sectional area of the metering plunger 7.

The protrusion 40 can also be used for setting the duration of the initial phase. That is, in the embodiment illustrated in FIGS. 13 & 14, the extent L to which protrusion 40 projects beyond the end of the pressure intensification plunger 5''' sets the depth to which the protrusion extends into the bore 42, so that this length L sets the duration of the initial phase of injection. The protrusion length L can suitably be 1 mm. It is also noted that the ratio of the area of the protrusion 40 to the area of the pressure intensification plunger 5''' is preferably about 1:8.

While various embodiments in accordance with the present invention have been shown and described, it is understood that the invention is not limited thereto, and is susceptible to numerous changes and modifications as known to those skilled in the art. For example, while the invention has been described for use in a pump-line-nozzle, common rail fuel injection system having a closed nozzle injector since it has been found to be particularly advantageous in this context, without significant modification, this invention can be applied to open nozzle type injectors or in systems which are not of the common rail type. Furthermore, the invention can be adapted for use in unit injector or other types of fuel injection systems besides pump-line-nozzle systems. Therefore, this invention is not limited to the details shown and described herein, and includes all such changes and modifications as are encompassed by the scope of the appended claims.

Application of the Invention

The present invention will find application to a wide variety of fuel injection systems for vehicle engines, especially diesel engines, where injection rate shaping of highly pressurized fuel is important to optimizing $NO_X$ emissions. In particular, the invention will find utility in pump-line-nozzle fuel injection systems having hydraulically actuated injectors which use a pressure intensifier to highly pressurize the fuel to be injected.

We claim:

1. A hydraulically actuated fuel injector of the type having a metering and injection plunger mounted for reciprocation in a metering and injection chamber into which fuel to be injected is metered and from which a metered quantity of fuel is injected, a hydraulically actuated pressure intensifier with a pressure intensification plunger which acts on said metering and injection plunger for displacement thereof in an injection stroke for forcing fuel from said metering and injection chamber and out of said injector, said pressure intensification plunger having an effective surface area which is acted upon by a source of pressurized hydraulic fluid supplied to the injector that is greater than an effective area of said metering and injection plunger that acts on fuel disposed in said metering and injection chamber; and means for partially reducing the effect of the pressurized hydraulic fluid which acts on said pressure intensification plunger during an initial phase of displacement thereof during said injection stroke and for applying the full effect of said pressurized hydraulic fluid to said pressure intensification plunger during a subsequent, second phase of displacement thereof during said injection stroke, whereby fuel is injected by said metering and injection plunger at a pressure above that of said pressurized hydraulic fluid and at a first rate during said initial phase, and fuel is injected by said metering and injection plunger at a pressure above that of said pressurized hydraulic fluid and at a second rate during said second phase, said second rate being greater than said first rate; wherein said means for partially reducing the effect of the pressurized hydraulic fluid comprises a protrusion on an upper end of the pressure intensification plunger and a receiving bore in a facing surface of a body of the pressure intensifier, said protrusion being disposed within said receiving bore during said initial phase of displacement; wherein the receiving bore has a larger diameter than the protrusion for producing a peripheral clearance space between the protrusion and the receiving bore when the protrusion is in said receiving bore; wherein said receiving bore is connected to said source of pressurized hydraulic fluid; wherein said protrusion has a length which forms a means for setting the duration of said initial phase; and wherein said peripheral clearance space forms a means for producing a throttling effect which reduces the pressure of said pressurized hydraulic fluid to which the upper end of the pressure intensification plunger is exposed during said initial phase.

* * * * *